US008121323B2

(12) United States Patent
Armstrong

(10) Patent No.: US 8,121,323 B2
(45) **Date of Patent: *Feb. 21, 2012**

(54) INTER-CHANNEL COMMUNICATION IN A MULTI-CHANNEL DIGITAL HEARING INSTRUMENT

(75) Inventor: Stephen W. Armstrong, Burlington (CA)

(73) Assignee: Semiconductor Components Industries, LLC, Phoenix, AZ (US)

( * ) Notice: Subject to any disclaimer, the term of this patent is extended or adjusted under 35 U.S.C. 154(b) by 1149 days.

This patent is subject to a terminal disclaimer.

(21) Appl. No.: 11/656,678

(22) Filed: Jan. 23, 2007

(65) Prior Publication Data

US 2007/0127752 A1 Jun. 7, 2007

Related U.S. Application Data

(63) Continuation of application No. 10/125,184, filed on Apr. 18, 2002, now Pat. No. 7,181,034.

(60) Provisional application No. 60/284,459, filed on Apr. 18, 2001.

(51) Int. Cl.
*H04R 25/00* (2006.01)

(52) U.S. Cl. ..... 381/321; 381/317; 381/313

(58) Field of Classification Search ..... 381/312, 381/317–318, 320–321

See application file for complete search history.

(56) References Cited

U.S. PATENT DOCUMENTS 4,119,814 A 10/1978 Harless
4,142,072 A 2/1979 Berland
4,187,413 A 2/1980 Moser
4,289,935 A 9/1981 Zollner et al.
4,403,118 A 9/1983 Zollner et al.
4,471,171 A 9/1984 Köpke et al.
4,508,940 A 4/1985 Steeger
4,592,087 A 5/1986 Killion
4,630,302 A 12/1986 Kryter (Continued)

FOREIGN PATENT DOCUMENTS

AU 637722 6/1993

(Continued)

OTHER PUBLICATIONS

Lunner, Thomas and Hellgren, Johan, "A Digital Filterbank Hearing Aid-Design, Implementation and Evaluation", Department of Electronic engineering and Department of Otorhinolaryngology, University of Linkoping, Sweden, pp. 3661-3664.

(Continued)

*Primary Examiner* — Davetta W Goins
*Assistant Examiner* — Phylesha Dabney
(74) *Attorney, Agent, or Firm* — Robert F. Hightower

(57) ABSTRACT

A multi-channel digital hearing instrument is provided that includes a microphone, an analog-to-digital (A/D) converter, a sound processor, a digital-to-analog (D/A) converter and a speaker. The microphone receives an acoustical signal and generates an analog audio signal. The A/D converter converts the analog audio signal into a digital audio signal. The sound processor includes channel processing circuitry that filters the digital audio signal into a plurality of frequency band-limited audio signals and that provides an automatic gain control function that permits quieter sounds to be amplified at a higher gain than louder sounds and may be configured to the dynamic hearing range of a particular hearing instrument user. The D/A converter converts the output from the sound processor into an analog audio output signal. The speaker converts the analog audio output signal into an acoustical output signal that is directed into the ear canal of the hearing instrument user.

15 Claims, 4 Drawing Sheets

U.S. PATENT DOCUMENTS

| | | | |
|---|---|---|---|
| 4,689,818 | A | 8/1987 | Ammitzboll |
| 4,689,820 | A | 8/1987 | Köpke et al. |
| 4,696,032 | A | 9/1987 | Levy |
| 4,701,953 | A | 10/1987 | White |
| 4,712,244 | A | 12/1987 | Zwicker et al. |
| 4,750,207 | A | 6/1988 | Gebert et al. |
| 4,852,175 | A | 7/1989 | Kates |
| 4,868,880 | A | 9/1989 | Bennett, Jr. |
| 4,882,762 | A | 11/1989 | Waldhauer |
| 4,947,432 | A | 8/1990 | Topholm |
| 4,947,433 | A | 8/1990 | Gebert |
| 4,953,216 | A | 8/1990 | Beer |
| 4,989,251 | A | 1/1991 | Mangold |
| 4,995,085 | A | 2/1991 | Kern et al. |
| 5,029,217 | A | 7/1991 | Chabries et al. |
| 5,046,102 | A | 9/1991 | Zwicker et al. |
| 5,111,419 | A | 5/1992 | Morley, Jr. et al. |
| 5,144,674 | A | 9/1992 | Meyer et al. |
| 5,189,704 | A | 2/1993 | Krauss |
| 5,201,006 | A | 4/1993 | Weinrich |
| 5,202,927 | A | 4/1993 | Topholm |
| 5,210,803 | A | 5/1993 | Martin et al. |
| 5,233,665 | A | 8/1993 | Vaughn et al. |
| 5,241,310 | A | 8/1993 | Tiemann |
| 5,247,581 | A | 9/1993 | Gurcan |
| 5,276,739 | A | 1/1994 | Krokstad et al. |
| 5,278,912 | A | 1/1994 | Waldhauer |
| 5,347,587 | A | 9/1994 | Takahashi et al. |
| 5,376,892 | A | 12/1994 | Gata |
| 5,389,829 | A | 2/1995 | Milazzo |
| 5,448,644 | A | 9/1995 | Pfannenmueller et al. |
| 5,479,522 | A | 12/1995 | Lindemann et al. |
| 5,500,902 | A | 3/1996 | Stockham, Jr. et al. |
| 5,515,443 | A | 5/1996 | Meyer |
| 5,524,150 | A | 6/1996 | Sauer |
| 5,604,812 | A | 2/1997 | Meyer |
| 5,608,803 | A | 3/1997 | Magotra et al. |
| 5,613,008 | A | 3/1997 | Martin |
| 5,649,019 | A | 7/1997 | Thomasson |
| 5,661,814 | A | 8/1997 | Kälin et al. |
| 5,687,241 | A | 11/1997 | Ludvigsen |
| 5,706,351 | A | 1/1998 | Weinfurtner |
| 5,710,820 | A | 1/1998 | Martin et al. |
| 5,717,770 | A | 2/1998 | Weinfurtner |
| 5,719,528 | A | 2/1998 | Rasmussen et al. |
| 5,754,661 | A | 5/1998 | Weinfurtner |
| 5,796,848 | A | 8/1998 | Martin |
| 5,809,151 | A | 9/1998 | Husung |
| 5,815,102 | A | 9/1998 | Melanson |
| 5,838,801 | A | 11/1998 | Ishige et al. |
| 5,838,806 | A | 11/1998 | Sigwanz et al. |
| 5,862,238 | A | 1/1999 | Agnew et al. |
| 5,878,146 | A | 3/1999 | Andersen |
| 5,896,101 | A | 4/1999 | Melanson |
| 5,912,977 | A | 6/1999 | Gottschalk-Schoenig |
| 6,005,954 | A | 12/1999 | Weinfurtner |
| 6,044,162 | A | 3/2000 | Mead et al. |
| 6,044,163 | A | 3/2000 | Weinfurtner |
| 6,047,075 | A | 4/2000 | Killion et al. |
| 6,049,617 | A | 4/2000 | Sigwanz et al. |
| 6,049,618 | A | 4/2000 | Saltkov |
| 6,108,431 | A | 8/2000 | Bachler |
| 6,175,635 | B1 | 1/2001 | Meyer et al. |
| 6,198,830 | B1 | 3/2001 | Holube et al. |
| 6,236,731 | B1 | 5/2001 | Brennan et al. |
| 6,240,192 | B1 | 5/2001 | Brennan et al. |
| 6,240,195 | B1 | 5/2001 | Binder et al. |
| 6,272,229 | B1 | 8/2001 | Backgaard |
| 6,480,610 | B1 | 11/2002 | Fang et al. |
| 6,606,391 | B2 | 8/2003 | Brennan et al. |
| 6,633,202 | B2 | 10/2003 | Yang et al. |
| 6,937,738 | B2 | 8/2005 | Armstrong et al. |
| 7,016,507 | B1 | 3/2006 | Brennan |
| 2003/0026442 | A1 | 2/2003 | Fang et al. |

FOREIGN PATENT DOCUMENTS

| | | | |
|---|---|---|---|
| DE | 4340817 | A1 | 6/1995 |
| DE | 19624092 | A1 | 11/1997 |
| EP | 89101149.6 | | 8/1989 |
| EP | 0483701 | | 10/1991 |
| EP | 91480009.9 | | 7/1992 |
| EP | 93203072.9 | | 5/1994 |
| EP | 1267491 | | 12/2002 |
| EP | 1251715 | | 2/2006 |
| JP | 2192300 | | 7/1990 |
| WO | WO8302212 | | 6/1983 |
| WO | WO8904583 | | 5/1989 |
| WO | 93/20668 | | 10/1993 |
| WO | WO9508248 | | 3/1995 |
| WO | WO9714266 | | 4/1997 |
| WO | 99/00896 | | 1/1999 |
| WO | 99/04598 | | 1/1999 |
| WO | 00/18184 | | 3/2000 |
| WO | 00/47014 | | 8/2000 |

OTHER PUBLICATIONS

Lee, Jo-Hong and Kang, wen-Juh, "Filter Design for Polyphase filter Banks with Arbitary Number of Subband Channels", Department of Electrical Engineering, National Taiwan, Republic of China, pp. 1720-1723.

Schneider et al., "A Multichannel Compression Strategy for a Digital Hearing Aid", Unitron Industries Ltd., Canada, 1997, pp. 411-414.

Notice of Opposition to a European Patent, Title of Patent: Multi-Channel Hearing Instrument with Inter-Channel Communication, Patent No. EP 1251715, dated Nov. 15, 2006.

EP Opposition Decision for EP Published Application No. EP1251715, a commonly assigned European counterpart application to the present application.

Sep. 7, 2009 Opposition filing for EP Published Application No. EP1251715.

Nov. 15, 2006 Opposition filing for EP Published Application No. EP1251715.

King Chung, "Challenges and Recent Developments in Hearing Aids: part I. Speech Understanding in Noise, Microphone Technologies and Noise Reduction Algorithms", Trends in Amplification, vol. 8, Nov. 3, 2004, Copyright 2004 SAGE Publications, pp. 83-124 (htpp://tia.sagepub.com/cgi/content/abstract/8/3/83).

INTER-CHANNEL COMMUNICATION IN A MULTI-CHANNEL DIGITAL HEARING INSTRUMENT

This is a continuation of U.S. patent application Ser. No. 10/125,184, file Apr. 18, 2002, now U.S. Pat. No. 7,181,034, which claims priority from and is related to the following prior application: Inter-Channel Communication In a Multi-Channel Digital Hearing Instrument, U.S. Provisional Application No. 60/284,459, filed Apr. 18, 2001.

BACKGROUND

1. Field of the Invention

This invention generally relates to digital hearing aid instruments. More specifically, the invention provides an advanced inter-channel communication system and method for multi-channel digital hearing aid instruments.

2. Description of the Related Art

Digital hearing aid instruments are known in this field. Multi-channel digital hearing aid instruments split the wide-bandwidth audio input signal into a plurality of narrow-bandwidth sub-bands, which are then digitally processed by an on-board digital processor in the instrument. In first generation multi-channel digital hearing aid instruments, each sub-band channel was processed independently from the other channels. Subsequently, some multi-channel instruments provided for coupling between the sub-band processors in order to refine the multi-channel processing to account for masking from the high-frequency channels down towards the lower-frequency channels.

A low frequency tone can sometimes mask the user's ability to hear a higher frequency tone, particularly in persons with hearing impairments. By coupling information from the high-frequency channels down towards the lower frequency channels, the lower frequency channels can be effectively turned down in the presence of a high frequency component in the signal, thus unmasking the high frequency tone. The coupling between the sub-bands in these instruments, however, was uniform from sub-band to sub-band, and did not provide for customized coupling between any two of the plurality of sub-bands. In addition, the coupling in these multi-channel instruments did not take into account the overall content of the input signal.

SUMMARY

A multi-channel digital hearing instrument is provided that includes a microphone, an analog-to-digital (A/D) converter, a sound processor, a digital-to-analog (D/A) converter and a speaker. The microphone receives an acoustical signal and generates an analog audio signal. The A/D converter converts the analog audio signal into a digital audio signal. The sound processor includes channel processing circuitry that filters the digital audio signal into a plurality of frequency band-limited audio signals and that provides an automatic gain control function that permits quieter sounds to be amplified at a higher gain than louder sounds and may be configured to the dynamic hearing range of a particular hearing instrument user. The D/A converter converts the output from the sound processor into an analog audio output signal. The speaker converts the analog audio output signal into an acoustical output signal that is directed into the ear canal of the hearing instrument user.

DETAILED DESCRIPTION

Figure 1A:
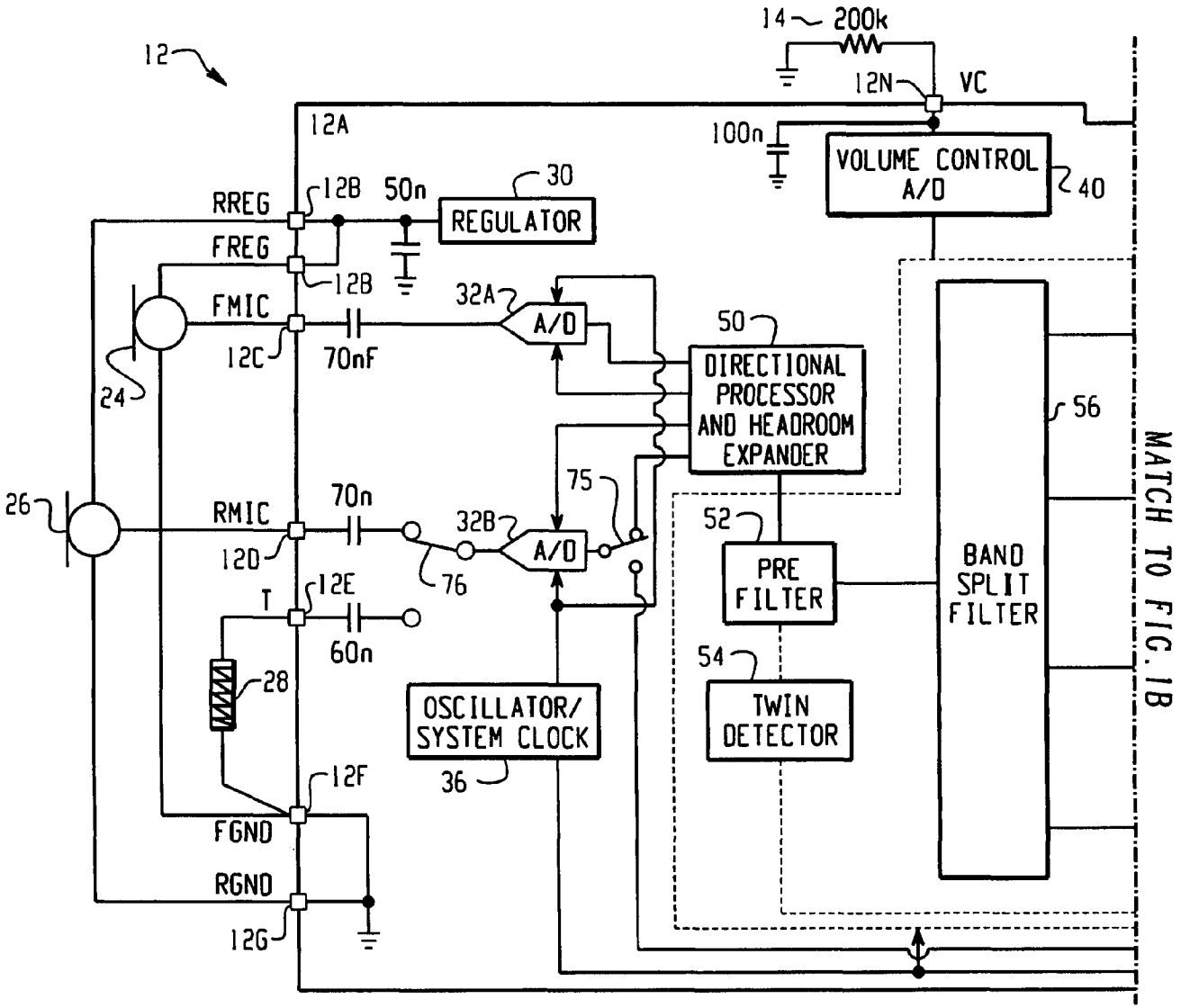
FIG. 1 is a block diagram of an exemplary digital hearing aid system according to the present invention.
Figure 1B:
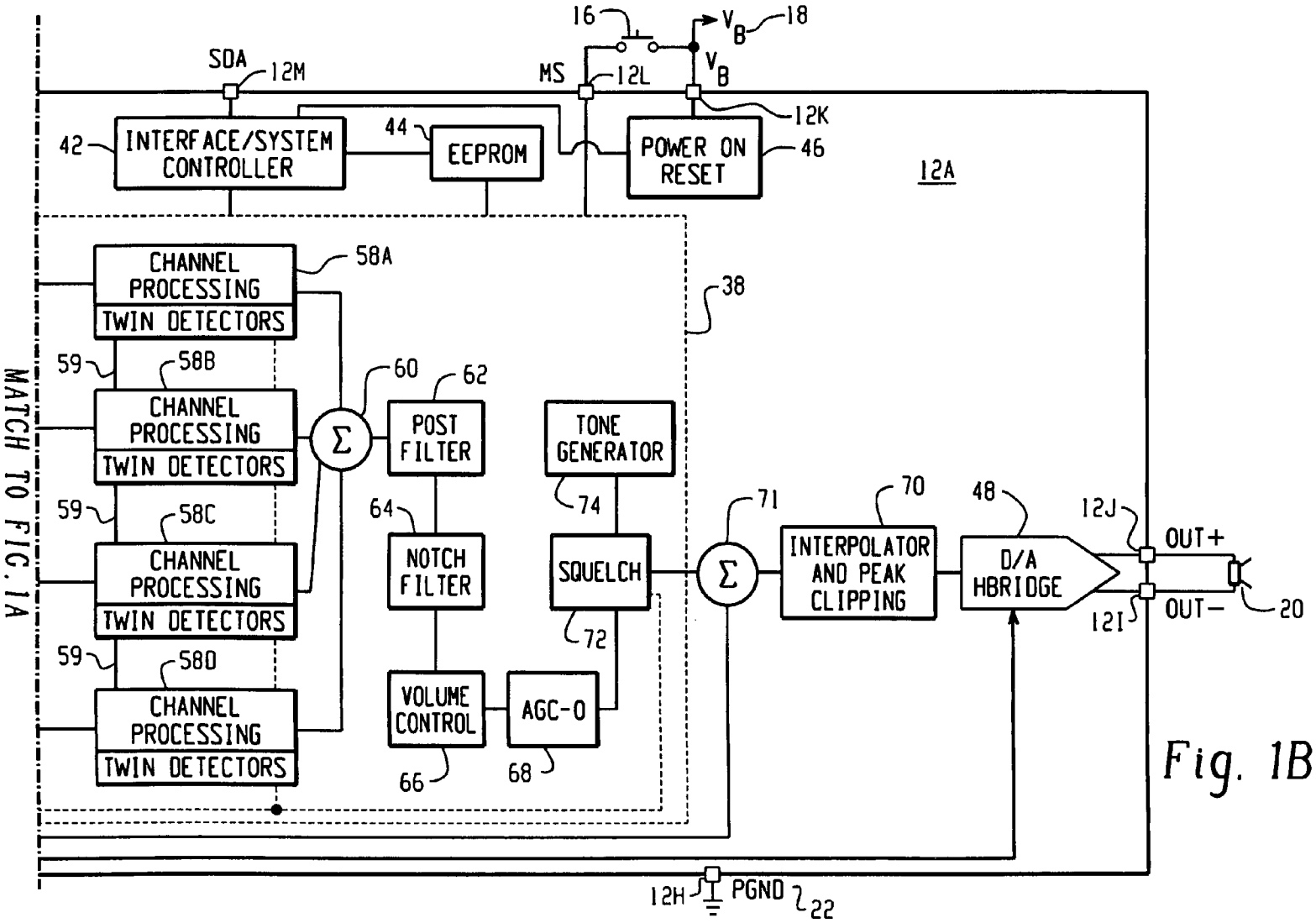

Turning now to the drawing figures, FIG. 1 is a block diagram of an exemplary digital hearing aid system 12. The digital hearing aid system 12 includes several external components 14, 16, 18, 20, 22, 24, 26, 28, and, preferably, a single integrated circuit (IC) 12A. The external components include a pair of microphones 24, 26, a tele-coil 28, a volume control potentiometer 24, a memory-select toggle switch 16, battery terminals 18, 22, and a speaker 20.

Sound is received by the pair of microphones 24, 26, and converted into electrical signals that are coupled to the FMIC 12C and RMIC 12D inputs to the IC 12A. FMIC refers to "front microphone," and RMIC refers to "rear microphone." The microphones 24, 26 are biased between a regulated voltage output from the RREG and FREG pins 12B, and the ground nodes FGND 12F and RGND 12G. The regulated voltage output on FREG and RREG is generated internally to the IC 12A by regulator 30.

The tele-coil 28 is a device used in a hearing aid that magnetically couples to a telephone handset and produces an input current that is proportional to the telephone signal. This input current from the tele-coil 28 is coupled into the rear microphone A/D converter 32B on the IC 12A when the switch 76 is connected to the "T" input pin 12E, indicating that the user of the hearing aid is talking on a telephone. The tele-coil 28 is used to prevent acoustic feedback into the system when talking on the telephone.

The volume control potentiometer 14 is coupled to the volume control input 12N of the IC. This variable resistor is used to set the volume sensitivity of the digital hearing aid.

The memory-select toggle switch 16 is coupled between the positive voltage supply VB 18 and the memory-select input pin 12L. This switch 16 is used to toggle the digital hearing aid system 12 between a series of setup configurations. For example, the device may have been previously programmed for a variety of environmental settings, such as quiet listening, listening to music, a noisy setting, etc. For each of these settings, the system parameters of the IC 12A may have been optimally configured for the particular user. By repeatedly pressing the toggle switch 16, the user may then toggle through the various configurations stored in the read-only memory 44 of the IC 12A.

The battery terminals 12K, 12H of the IC 12A are preferably coupled to a single 1.3 volt zinc-air battery. This battery provides the primary power source for the digital hearing aid system.

The last external component is the speaker 20. This element is coupled to the differential outputs at pins 12J, 12I of the IC 12A, and converts the processed digital input signals from the two microphones 24, 26 into an audible signal for the user of the digital hearing aid system 12.

There are many circuit blocks within the IC 12A. Primary sound processing within the system is carried out by a sound processor 38 and a directional processor and headroom expander 50. A pair of A/D converters 32A, 32B are coupled between the front and rear microphones 24, 26, and the directional processor and headroom expander 50, and convert the analog input signals into the digital domain for digital processing. A single D/A converter 48 converts the processed digital signals back into the analog domain for output by the speaker 20. Other system elements include a regulator 30, a volume control A/D 40, an interface/system controller 42, an EEPROM memory 44, a power-on reset circuit 46, a oscillator/system clock 36, a summer 71, and an interpolator and peak clipping circuit 70.

The sound processor 38 preferably includes a pre-filter 52, a wide-band twin detector 54, a band-split filter 56, a plurality of narrow-band channel processing and twin detectors 58A-58D, a summation block 60, a post filter 62, a notch filter 64, a volume control circuit 66, an automatic gain control output circuit 68, an interpolator and peak clipping circuit 70, a squelch circuit 72, a summation block 71, and a tone generator 74.

Operationally, the digital hearing aid system 12 processes digital sound as follows. Analog audio signals picked up by the front and rear microphones 24, 26 are coupled to the front and rear A/D converters 32A, 32B, which are preferably Sigma-Delta modulators followed by decimation filters that convert the analog audio inputs from the two microphones into equivalent digital audio signals. Note that when a user of the digital hearing aid system is talking on the telephone, the rear A/D converter 32B is coupled to the tele-coil input "T" 12E via switch 76. Both the front and rear A/D converters 32A, 32B are clocked with the output clock signal from the oscillator/system clock 36 (discussed in more detail below). This same output clock signal is also coupled to the sound processor 38 and the D/A converter 48.

The front and rear digital sound signals from the two A/D converters 32A, 32B are coupled to the directional processor and headroom expander 50 of the sound processor 38. The rear A/D converter 32B is coupled to the processor 50 through switch 75. In a first position, the switch 75 couples the digital output of the rear A/D converter 32 B to the processor 50, and in a second position, the switch 75 couples the digital output of the rear A/D converter 32B to summation block 71 for the purpose of compensating for occlusion.

Occlusion is the amplification of the users own voice within the ear canal. The rear microphone can be moved inside the ear canal to receive this unwanted signal created by the occlusion effect. The occlusion effect is usually reduced by putting a mechanical vent in the hearing aid. This vent, however, can cause an oscillation problem as the speaker signal feeds back to the microphone(s) through the vent aperture. Another problem associated with traditional venting is a reduced low frequency response (leading to reduced sound quality). Yet another limitation occurs when the direct coupling of ambient sounds results in poor directional performance, particularly in the low frequencies. The system shown in FIG. 1 solves these problems by canceling the unwanted signal received by the rear microphone 26 by feeding back the rear signal from the A/D converter 32B to summation circuit 71. The summation circuit 71 then subtracts the unwanted signal from the processed composite signal to thereby compensate for the occlusion effect.

The directional processor and headroom expander 50 includes a combination of filtering and delay elements that, when applied to the two digital input signals, form a single, directionally-sensitive response. This directionally-sensitive response is generated such that the gain of the directional processor 50 will be a maximum value for sounds coming from the front microphone 24 and will be a minimum value for sounds coming from the rear microphone 26.

The headroom expander portion of the processor 50 significantly extends the dynamic range of the A/D conversion, which is very important for high fidelity audio signal processing. It does this by dynamically adjusting the operating points of the A/D converters 32A/32B. The headroom expander 50 adjusts the gain before and after the A/D conversion so that the total gain remains unchanged, but the intrinsic dynamic range of the A/D converter block 32A/32B is optimized to the level of the signal being processed.

The output from the directional processor and headroom expander 50 is coupled to the pre-filter 52 in the sound processor, which is a general-purpose filter for pre-conditioning the sound signal prior to any further signal processing steps. This "pre-conditioning" can take many forms, and, in combination with corresponding "post-conditioning" in the post filter 62, can be used to generate special effects that may be suited to only a particular class of users. For example, the pre-filter 52 could be configured to mimic the transfer function of the user's middle ear, effectively putting the sound signal into the "cochlear domain." Signal processing algorithms to correct a hearing impairment based on, for example, inner hair cell loss and outer hair cell loss, could be applied by the sound processor 38. Subsequently, the post-filter 62 could be configured with the inverse response of the pre-filter 52 in order to convert the sound signal back into the "acoustic domain" from the "cochlear domain." Of course, other pre-conditioning/post-conditioning configurations and corresponding signal processing algorithms could be utilized.

The pre-conditioned digital sound signal is then coupled to the band-split filter 56, which preferably includes a bank of filters with variable corner frequencies and pass-band gains. These filters are used to split the single input signal into four distinct frequency bands. The four output signals from the band-split filter 56 are preferably in-phase so that when they are summed together in summation block 60, after channel processing, nulls or peaks in the composite signal (from the summation block) are minimized.

Channel processing of the four distinct frequency bands from the band-split filter 56 is accomplished by a plurality of channel processing/twin detector blocks 58A-58D. Although four blocks are shown in FIG. 1, it should be clear that more than four (or less than four) frequency bands could be generated in the band-split filter 56, and thus more or less than four channel processing/twin detector blocks 58 may be utilized with the system.

Each of the channel processing/twin detectors 58A-58D provide an automatic gain control ("AGC") function that provides compression and gain on the particular frequency band (channel) being processed. Compression of the channel signals permits quieter sounds to be amplified at a higher gain than louder sounds, for which the gain is compressed. In this manner, the user of the system can hear the full range of sounds since the circuits 58A-58D compress the full range of normal hearing into the reduced dynamic range of the individual user as a function of the individual user's hearing loss within the particular frequency band of the channel.

The channel processing blocks 58A-58D can be configured to employ a twin detector average detection scheme while compressing the input signals. This twin detection scheme includes both slow and fast attack/release tracking modules that allow for fast response to transients (in the fast tracking module), while preventing annoying pumping of the input signal (in the slow tracking module) that only a fast time constant would produce. The outputs of the fast and slow tracking modules are compared, and the compression parameters are then adjusted accordingly. For example, if the output level of the fast tracking module exceeds the output level of the slow tracking module by some pre-selected level, such as 6 dB, then the output of the fast tracking module may be temporarily coupled as the input to a gain calculation block (see FIG. 3). The compression ratio, channel gain, lower and upper thresholds (return to linear point), and the fast and slow time constants (of the fast and slow tracking modules) can be independently programmed and saved in memory 44 for each of the plurality of channel processing blocks 58A-58D.

FIG. 1 also shows a communication bus 59, which may include one or more connections for coupling the plurality of channel processing blocks 58A-58D. This inter-channel communication bus 59 can be used to communicate information between the plurality of channel processing blocks 58A-58D such that each channel (frequency band) can take into account the "energy" level (or some other measure) from the other channel processing blocks. Preferably, each channel processing block 58A-58D would take into account the "energy" level from the higher frequency channels. In addition, the "energy" level from the wide-band detector 54 may be used by each of the relatively narrow-band channel processing blocks 58A-58D when processing their individual input signals.

After channel processing is complete, the four channel signals are summed by summation bock 60 to form a composite signal. This composite signal is then coupled to the post-filter 62, which may apply a post-processing filter function as discussed above. Following post-processing, the composite signal is then applied to a notch-filter 64, that attenuates a narrow band of frequencies that is adjustable in the frequency range where hearing aids tend to oscillate. This notch filter 64 is used to reduce feedback and prevent unwanted "whistling" of the device. Preferably, the notch filter 64 may include a dynamic transfer function that changes the depth of the notch based upon the magnitude of the input signal.

Following the notch filter 64, the composite signal is coupled to a volume control circuit 66. The volume control circuit 66 receives a digital value from the volume control A/D 40, which indicates the desired volume level set by the user via potentiometer 14, and uses this stored digital value to set the gain of an included amplifier circuit.

From the volume control circuit, the composite signal is coupled to the AGC-output block 68. The AGC-output circuit 68 is a high compression ratio, low distortion limiter that is used to prevent pathological signals from causing large scale distorted output signals from the speaker 20 that could be painful and annoying to the user of the device. The composite signal is coupled from the AGC-output circuit 68 to a squelch circuit 72, that performs an expansion on low-level signals below an adjustable threshold. The squelch circuit 72 uses an output signal from the wide-band detector 54 for this purpose. The expansion of the low-level signals attenuates noise from the microphones and other circuits when the input S/N ratio is small, thus producing a lower noise signal during quiet situations. Also shown coupled to the squelch circuit 72 is a tone generator block 74, which is included for calibration and testing of the system.

The output of the squelch circuit 72 is coupled to one input of summation block 71. The other input to the summation bock 71 is from the output of the rear A/D converter 32B, when the switch 75 is in the second position. These two signals are summed in summation block 71, and passed along to the interpolator and peak clipping circuit 70. This circuit 70 also operates on pathological signals, but it operates almost instantaneously to large peak signals and is high distortion limiting. The interpolator shifts the signal up in frequency as part of the D/A process and then the signal is clipped so that the distortion products do not alias back into the baseband frequency range.

The output of the interpolator and peak clipping circuit 70 is coupled from the sound processor 38 to the D/A H-Bridge 48. This circuit 48 converts the digital representation of the input sound signals to a pulse density modulated representation with complimentary outputs. These outputs are coupled off-chip through outputs 12J, 12I to the speaker 20, which low-pass filters the outputs and produces an acoustic analog of the output signals. The D/A H-Bridge 48 includes an interpolator, a digital Delta-Sigma modulator, and an H-Bridge output stage. The D/A H-Bridge 48 is also coupled to and receives the clock signal from the oscillator/system clock 36 (described below).

The interface/system controller 42 is coupled between a serial data interface pin 12M on the IC 12, and the sound processor 38. This interface is used to communicate with an external controller for the purpose of setting the parameters of the system. These parameters can be stored on-chip in the EEPROM 44. If a "black-out" or "brown-out" condition occurs, then the power-on reset circuit 46 can be used to signal the interface/system controller 42 to configure the system into a known state. Such a condition can occur, for example, if the battery fails.

Figure 2:
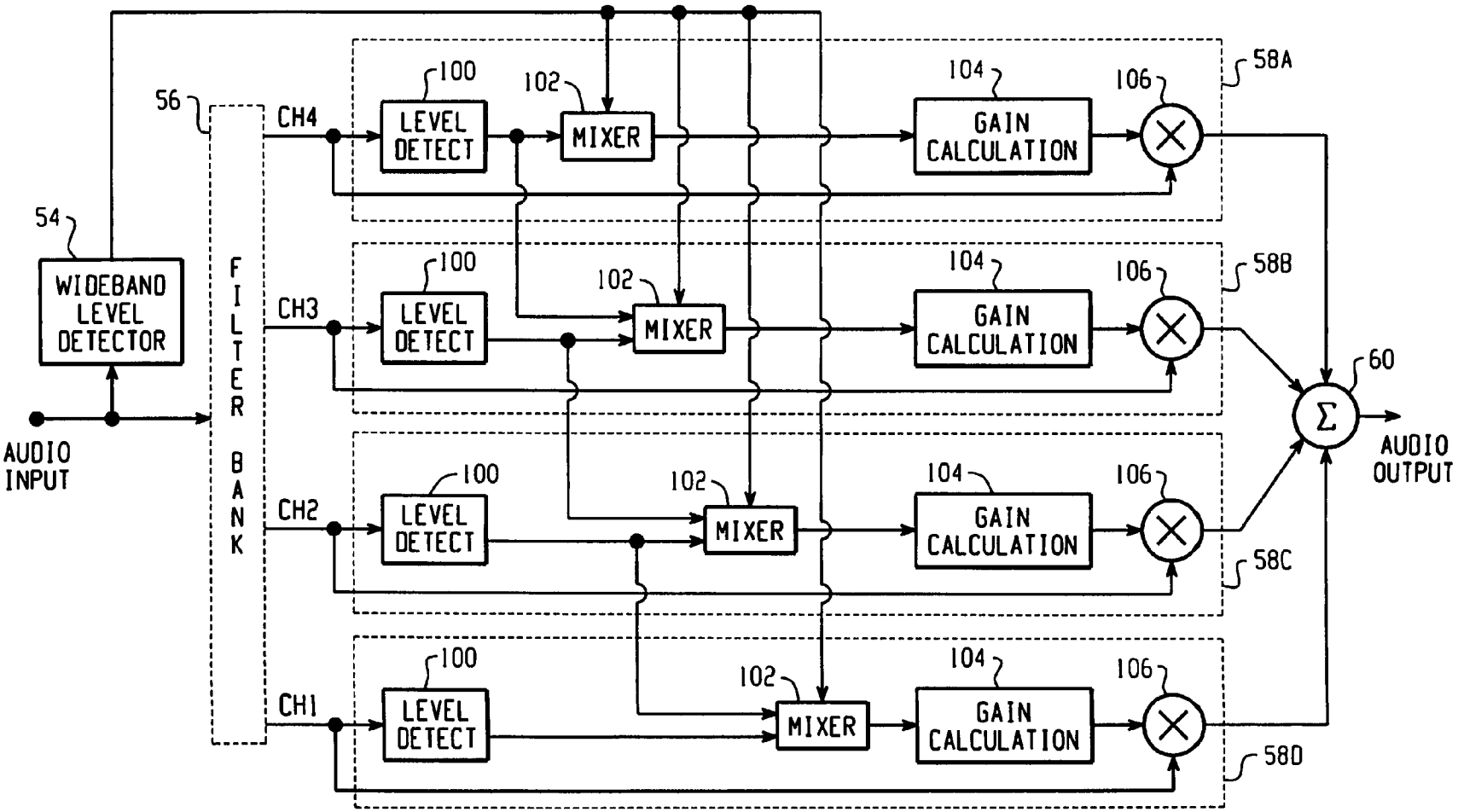
FIG. 2 is an expanded block diagram of the channel processing/twin detector circuitry shown in FIG. 1.

FIG. 2 is an expanded block diagram showing the channel processing/twin detector circuitry 58A-58D shown in FIG. 1. This figure also shows the wideband twin detector 54, the band split filter 56, which is configured in this embodiment to provide four narrow-bandwidth channels (Ch. 1 through Ch. 4), and the summation block 60. In this figure, it is assumed that Ch. 1 is the lowest frequency channel and Ch. 4 is the highest frequency channel. In this circuit, as described in more detail below, level information from the higher frequency channels are provided down to the lower frequency channels in order to compensate for the masking effect.

Each of the channel processing/twin detector blocks 58A-58D include a channel level detector 100, which is preferably a twin detector as described previously, a mixer circuit 102, described in more detail below with reference to FIG. 3, a gain calculation block 104, and a multiplier 106.

Each channel (Ch. 1-Ch. 4) is processed by a channel processor/twin detector (58A-58D), although information from the wideband detector 54 and, depending on the channel, from a higher frequency channel, is used to determine the correct gain setting for each channel. The highest frequency channel (Ch. 4) is preferably processed without information from another narrow-band channel, although in some implementations it could be.

Consider, for example, the lowest frequency channel—Ch. 1. The Ch. 1 output signal from the filter bank 56 is coupled to the channel level detector 100, and is also coupled to the multiplier 106. The channel level detector 100 outputs a positive value representative of the RMS energy level of the audio signal on the channel. This RMS energy level is coupled to one input of the mixer 102. The mixer 102 also receives RMS energy level inputs from a higher frequency channel, in this case from Ch. 2, and from the wideband detector 54. The wideband detector 54 provides an RMS energy level for the entire audio signal, as opposed to the level for Ch. 2, which represents the RMS energy level for the sub-bandwidth associated with this channel.

As described in more detail below with reference to FIG. 3, the mixer 102 multiplies each of these three RMS energy level inputs by a programmable constant and then combines these multiplied values into a composite level signal that includes information from: (1) the channel being processed; (2) a higher frequency channel; and (3) the wideband level detector. Although FIG. 2 shows each mixer being coupled to one higher frequency channel, it is possible that the mixer could be coupled to a plurality of higher frequency or lower frequency channels in order to provide a more sophisticated anti-masking scheme.

The composite level signal from the mixer is provided to the gain calculation block 104. The purpose of the gain calculation block 104 is to compute a gain (or volume) level for the channel being processed. This gain level is coupled to the multiplier 106, which operates like a volume control knob on a stereo to either turn up or down the amplitude of the channel signal output from the filter bank 56. The outputs from the four channel multipliers 106 are then added by the summation block 60 to form a composite audio output signal.

Preferably, the gain calculation block 104 applies an algorithm to the output of the mixer 102 that compresses the mixer output signal above a particular threshold level. In the gain calculation block 104, the threshold level is subtracted from the mixer output signal to form a remainder. The remainder is then compressed using a log/anti-log operation and a compression multiplier. This compressed remainder is then added back to the threshold level to form the output of the gain processing block 104.

Figure 3:
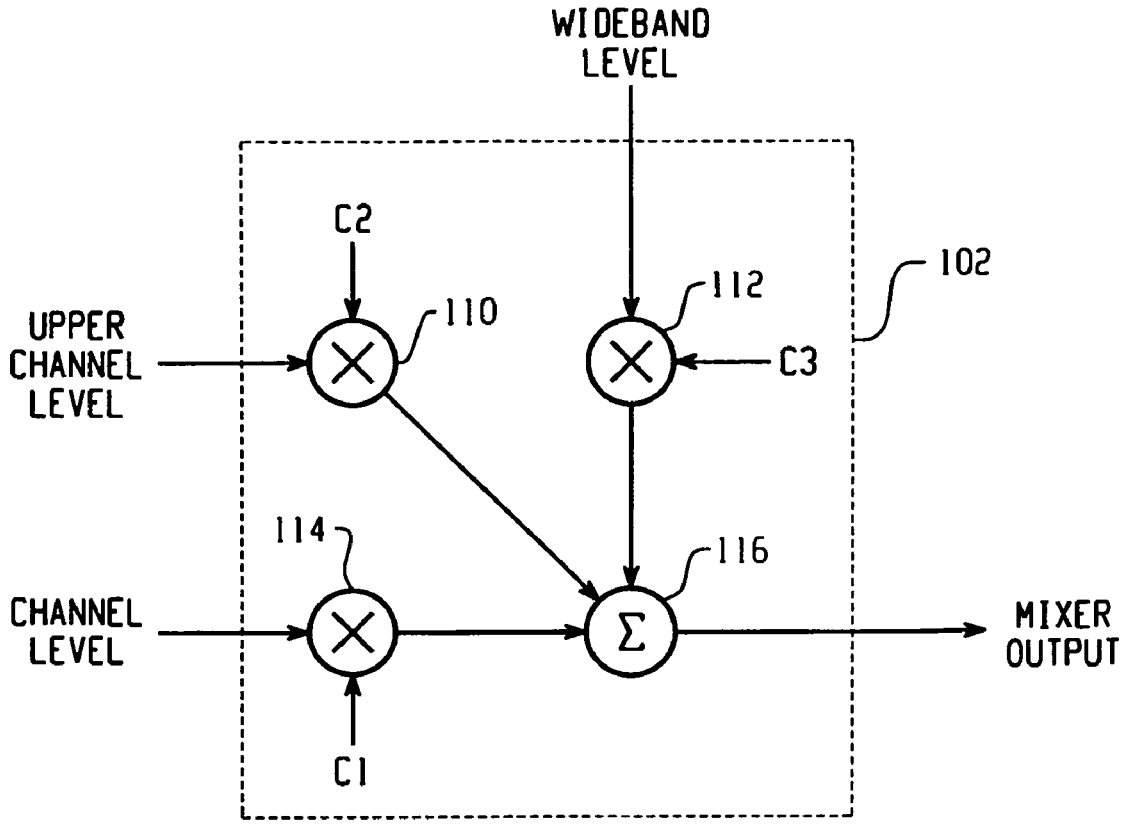
FIG. 3 is an expanded block diagram of one of the mixers shown in FIG. 2.

FIG. 3 is an expanded block diagram of one of the mixers 102 shown in FIG. 2. The mixer 102 includes three multipliers 110, 112, 114 and a summation block 116. The mixer 102 receives three input levels from the wideband detector 54, the upper channel level, and the channel being processed by the particular mixer 102. Three, independently-programmable, coefficients C1, C2, and C3 are applied to the three input levels by the three multipliers 110, 112, and 114. The outputs of these multipliers are then added by the summation block 116 to form a composite output level signal. This composite output level signal includes information from the channel being processed, the upper level channel, and from the wideband detector 54. Thus, the composite output signal is given by the following equation: Composite Level=(Wideband Level*C3+Upper Level*C2+Channel Level*C1).

The technology described herein may provide several advantages over known multi-channel digital hearing instruments. First, the inter-channel processing takes into account information from a wideband detector. This overall loudness information can be used to better compensate for the masking effect. Second, each of the channel mixers includes independently programmable coefficients to apply to the channel levels. This provides for much greater flexibility in customizing the digital hearing instrument to the particular user, and in developing a customized channel coupling strategy. For example, with a four-channel device such as shown in FIG. 1, the invention provides for 4,194,304 different settings using the three programmable coefficients on each of the four channels.

This written description uses examples to disclose the invention, including the best mode, and also to enable any person skilled in the art to make and use the invention. The patentable scope of the invention is defined by the claims, and may include other examples that occur to those skilled in the art.

It is claimed:

1. A method for processing an audio signal in a digital hearing instrument, comprising the steps of:

receiving an acoustical signal;

converting the acoustical signal into a wideband audio signal;

filtering the wideband audio signal into a plurality of channel audio signals;

determining a first energy level for one channel audio signal;

determining a second energy level for the wideband audio signal;

amplifying the one channel audio signal by a gain, wherein the gain is a function of the first and second energy levels; and combining the channel audio signals to generate a composite audio signal.

2. The method of claim 1, comprising the further step of:

determining a third energy level for one other channel audio signal, wherein the gain is a function of the first, second and third energy levels.

3. The method of claim 1, comprising the further steps of:

weighting the first energy level by a first pre-selected coefficient; and weighting the second energy level by a second pre-selected coefficient.

4. The method of claim 3, wherein the first and second pre-selected coefficients are determined according to hearing loss characteristics of an individual hearing instrument user.

5. The method of claim 2, comprising the further steps of:

weighting the first energy level by a first pre-selected coefficient;

weighting the second energy level by a second pre-selected coefficient; and weighting the third energy level by a third pre-selected coefficient.

6. The method of claim 5, wherein the first, second and third pre-selected coefficients are determined according to hearing loss characteristics of an individual hearing instrument user.

7. A method for processing an audio signal in a digital hearing instrument, comprising the steps of:

receiving an acoustical signal;

converting the acoustical signal into a wideband audio signal;

filtering the wideband audio signal into a plurality of channel audio signals; determining a first energy level for one channel audio signal;

determining a second energy level for one other channel audio signal;

amplifying the one channel audio signal by a gain, wherein the gain is a function of the first and second energy levels; and combining the channel audio signal to generate a composite audio signal.

8. The method of claim 7, comprising the further step of:

determining a third energy level for the wideband audio signal, wherein the gain is a function of the first, second and third energy levels.

9. The method of claim 7 comprising the further steps of:

weighting the first energy level by a first pre-selected coefficient; and weighting the second energy level, by a second pre-selected coefficient.

10. The method of claim 9, wherein the first and second pre-selected coefficients are determined according to hearing loss characteristics of an individual hearing instrument user.

11. The method of claim 8, comprising the further steps of:

weighting the first energy level by a first pre-selected coefficient;

weighting the second energy level by a second pre-selected coefficient; and weighting the third energy level by a third pre-selected coefficient.

12. The method of claim 11, wherein the first, second and third pre-selected coefficients are determines according to hearing loss characteristics of an individual hearing instrument user.

13. An amplification circuit for a digital hearing instrument, comprising:

a receiving circuit that receives an audio signal and converts the audio signal into a wideband digital audio signal;

a band-split filter coupled to the receiving circuit that filters the wideband digital audio signal into a plurality of channel digital audio signals;

a plurality of channel processors coupled to the band-split filter that each set a gain for one channel digital audio signal as a function of both the energy level of the one channel digital audio signal and the energy level of at least one other digital audio signal to generate a conditioned channel signal; and a summation circuit coupled to the plurality of channel processors that sums the conditioned channel signals from the channel processors and generates a composite output signal.

14. A method for forming a digital hearing instrument, comprising:

configuring the digital hearing instrument to receive an acoustical signal;

configuring the digital hearing instrument to convert the acoustical signal into a wideband audio signal;

configuring the digital hearing instrument to filter the wideband audio signal into a plurality of channel audio signals;

configuring the digital hearing instrument to determine a first energy level for a first channel audio signal;

configuring the digital hearing instrument to determine a second energy level for the wideband audio signal;

configuring the digital hearing instrument to determine a third energy level for a second channel audio signal;

configuring the digital hearing instrument to amplify the one channel audio signal by a gain, wherein the gain is a function of the first, second, and third energy levels; and configuring the digital hearing instrument to combine the channel audio signals to generate a composite audio signal.

15. The method of claim 14 wherein configuring the digital hearing instrument to amplify the first channel audio signal includes configuring a first audio channel to include a mixer wherein the mixer is coupled to receive the first, second, and third energy level signals, to multiply the first, second, and third energy level signals by pre-selected coefficients that are selected to compensate for the hearing loss of a particular user of the digital hearing instrument, and to sum together the multiplied signals.

* * * * *

UNITED STATES PATENT AND TRADEMARK OFFICE

CERTIFICATE OF CORRECTION

PATENT NO. : 8,121,323 B2
APPLICATION NO. : 11/656678
DATED : February 21, 2012
INVENTOR(S) : Stephen W. Armstrong It is certified that error appears in the above-identified patent and that said Letters Patent is hereby corrected as shown below:

Title Page, at (73) correct the assignee:

(73) Assignee: SOUND DESIGN TECHNOLOGIES LTD., Burlington, Ontario, CANADA

Signed and Sealed this
Third Day of April, 2012

David J. Kappos

David J. Kappos
*Director of the United States Patent and Trademark Office*